US005509243A

United States Patent [19]

Bettigole et al.

[11] Patent Number: 5,509,243

[45] Date of Patent: Apr. 23, 1996

[54] EXODERMIC DECK SYSTEM

[76] Inventors: Neal H. Bettigole, 89 Howard Dr., Old Tappan, N.J. 07675; Robert A. Bettigole, 21 Robin Hill Rd., Scarsdale, N.Y. 10583

[21] Appl. No.: 183,945

[22] Filed: Jan. 21, 1994

[51] Int. Cl.[6] ..... E01D 19/12; E04B 5/23

[52] U.S. Cl. ..... 52/334; 14/73; 52/338; 52/414; 52/667

[58] Field of Search ..... 14/73, 74.5; 52/333, 52/334, 337, 338, 414, 435, 600, 667; 404/134

[56] References Cited

U.S. PATENT DOCUMENTS

| | | | |
|---|---|---|---|
| 185,302 | 12/1876 | Davison . | |
| 1,033,106 | 7/1912 | Kahn . | |
| 1,300,439 | 4/1919 | Madison . | |
| 1,613,063 | 1/1927 | Stark . | |
| 1,936,536 | 11/1933 | Bates . | |
| 1,964,944 | 12/1934 | Piccirilli . | |
| 2,053,135 | 9/1936 | Dalton . | |
| 2,096,629 | 10/1937 | Farrar et al. . | |
| 2,128,753 | 8/1938 | Lienhard . | |
| 2,162,742 | 6/1939 | Nagin . | |
| 2,184,146 | 12/1939 | Leguillon . | |
| 2,190,214 | 2/1940 | Nagin . | |
| 2,233,054 | 2/1941 | Heeren | 52/435 |
| 2,246,766 | 6/1941 | Tarof . | |
| 2,307,869 | 1/1943 | Tench . | |
| 2,437,095 | 3/1948 | Kahr . | |
| 2,645,985 | 7/1953 | Beebe et al. . | |
| 2,834,267 | 5/1958 | Beebe . | |
| 2,880,116 | 3/1959 | Alps et al. . | |
| 3,110,049 | 11/1963 | Nagin . | |
| 3,110,981 | 11/1963 | Larner . | |
| 3,253,289 | 5/1966 | Nagin | 14/73 |
| 3,260,023 | 7/1966 | Nagin . | |
| 3,269,071 | 8/1966 | Johnson | 52/338 |
| 3,305,991 | 2/1967 | Weismann . | |
| 3,363,379 | 1/1968 | Curran . | |
| 3,385,181 | 5/1968 | Stoll . | |

(List continued on next page.)

FOREIGN PATENT DOCUMENTS

| | | | |
|---|---|---|---|
| 1377320 | 9/1964 | France | 52/667 |

OTHER PUBLICATIONS

Brochure: Greulich Bridge Flooring Systems, Easco Industrial Products, pp. 3–15, 1982.

Composite Construction in Steel and Concrete, "Recent Designs of Composite Bridges and a New Type of Shear Connectors", Wilhelm Zellner, M. ASCE, New England College, Henniker, New Hampshure, Jun. 7–12, 1987, Published by American Society of Civil Engineers, New York, New York.

*Primary Examiner*—Carl D. Friedman
*Assistant Examiner*—Kevin D. Wilkens
*Attorney, Agent, or Firm*—Banner & Allegretti, Ltd

[57] ABSTRACT

An exodermic deck for structural floors including bridge floors, road beds, pedestrian walkways, or the like, comprises a composite structure of a grid component and a top component. The grid component is preferably made of steel and includes a plurality of main bearing bars and a plurality of distribution bars oriented perpendicular to the main bearing bars. The top component is preferably made from reinforced concrete. The upper portions of either the main bearing bars or the distribution bars are embedded in the reinforced concrete component permitting horizontal shear transfer and creating a composite deck structure which maximizes the use of tensile strength of steel and the compressive strength of concrete. The top sections of the embedded bars have gripping surfaces for effecting mechanical locks between the grid component and the concrete component and increasing the horizontal shear transfer therebetween. Studs may be welded to the upper portions of the embedded bars to further affect horizontal shear transfer and enhance the performance of the composite deck structure. If desired, the top component may be made from materials other than concrete, such as an epoxy-aggregate, while the bars of the grid component may be made from materials other than steel, such as fiber-reinforced plastic.

12 Claims, 3 Drawing Sheets

U.S. PATENT DOCUMENTS 3,545,348 12/1970 Anderson .
3,645,510 2/1972 Klugman .
3,855,747 12/1974 Langan .
3,906,571 9/1975 Zetlin .
3,956,864 5/1976 Fung ..... 52/414
4,102,102 7/1978 Greulich .
4,112,640 9/1978 Reifsnyder .
4,145,153 3/1979 Fasullo et al. .
4,151,025 4/1979 Jacobs .
4,168,924 9/1979 Draper et al. .
4,201,023 5/1980 Jungbluth .
4,244,768 1/1981 Wiechowski et al. .
4,271,555 6/1981 Mingolla et al. .
4,282,619 8/1981 Rooney .
4,300,320 11/1981 Rooney .
4,486,996 12/1984 Alejos .
4,531,857 7/1985 Bettigole .
4,531,859 7/1985 Bettigole .
4,660,341 4/1987 Holtz ..... 52/337 X
4,700,519 10/1987 Person et al. .
4,727,704 5/1988 Carlton ..... 52/667
4,780,021 10/1988 Bettigole .
4,785,600 11/1988 Ting ..... 52/414 X
4,865,486 9/1989 Bettigole .
5,339,475 8/1994 Jaeger et al. ..... 14/73

24
68
66
25"
26
22
16"

24
62
64
58
60
25'
22
16'
26

24
48
54
50
45
44
56
52
25
26
22
16

EXODERMIC DECK SYSTEM

TECHNICAL FIELD

The present invention relates to an improved construction of bridges, roads, and sidewalks. More particularly, the present invention relates to an improved exodermic deck which utilizes a continuous reinforced concrete component and a steel grid to achieve a stronger, lighter-weight, more reliable, and less expensive deck.

BACKGROUND OF THE INVENTION

The widespread deterioration of road structures, specifically bridges, has been acknowledged as a critical problem in our Nation's transportation system. The Federal Government considers hundreds of thousands of bridges structurally deficient or functionally obsolete. A major factor in the problems of bridges are bridge decks, whose life span averages only one half the service life of the average bridge.

The rehabilitation and redecking of existing deficient structures, as well as deck designs for new structures, must account for many factors affecting bridge construction and rehabilitation. These factors include increased usage, increased loading, reduced maintenance, increased use of salts for snow, and the need for lower costs, lighter weight, and more efficient construction techniques. Prior to the advent of exodermic decks, the available deck designs included some specific beneficial characteristics, but none have all of the features required to meet current needs. U.S. Pat. Nos. 4,531,857, 4,531,859, 4,780,021, and 4,865,486 disclose exodermic decks and exodermic deck conversion methods which have met all the above design factors with unparalleled success.

An exodermic or "unfilled, composite, steel grid" deck consists of a composite concrete component and a steel grid component. A thin, reinforced concrete component is cast above an open, unfilled grid component forming a composite deck section. Shear transfer elements from the grid component are embedded into the concrete component providing the capability to transfer horizontal shear forces between the reinforced concrete component and the steel grid component and preventing vertical separation between the concrete component and the steel grid component.

An exodermic deck achieves enhanced composite behavior. Also, in a typical exodermic construction, the neutral axis of the composite deck is relocated near the top of the grid component. This reduces the maximum stress level in the top surface of the grid component to a point at which fatigue failure should not occur. An exodermic deck maximizes the use of the compressive strength of concrete and the tensile strength of steel to significantly increase the deck section properties over that of known conventional deck constructions of equal weight. The advantages achieved by exodermic decks also include reduced weight, rapid installation, increased strength, longer expected life and increased design flexibility.

Exodermic decks can be lighter than conventional decks of comparable load design. This reduction of weight results in significant savings on new steel framing and substructures and significantly upgrades the live load capacity of existing bridges. A further benefit achieved by the reduction of weight is the favorable effect on the fatigue life of bridge members.

Structural testing to date has shown that exodermic decks can be expected to have a fatigue life in excess of other deck configurations at comparable load design capacities. An exodermic deck eliminates potential fatigue failure thereby extending the useful life of the deck.

Additionally, exodermic bridge decks can easily be designed for numerous varying size and strength requirements. Exodermic decks can be cast-in-place or prefabricated in sections and transported to the site for installation. A cast-in-place exodermic deck provides a continuous concrete surface which can be maintained in the same manner as any reinforced concrete deck, at significantly lower weight. Exodermic decks which are prefabricated in sections permit rapid installation without regard to the weather and create the ability to utilize an off-site rigid quality control system for the deck.

Moreover, an exodermic deck eliminates skidding and noise problems commonly associated with open grid deck bridges and with filled grid deck bridges which do not have a wearing surface above the grid.

An exodermic deck design, used on all installations to date, includes a concrete component and a steel grid component comprised of main bearing bars, secondary or distribution bars, and tertiary bars. Short vertical dowels or studs are preferably welded to the tertiary bars. The top portion of the tertiary bars and the vertical dowels welded thereto are embedded in the concrete component to transfer the shear forces between the concrete component and the steel grid component and prevent any vertical separation between the concrete component and the steel grid component.

SUMMARY OF THE INVENTION

It is an object of this invention to provide an alternative exodermic deck design which eliminates the necessity for tertiary bars, vertical studs, or other separate shear transfer elements. This significantly reduces material and assembly costs and still provides the unsurpassed strength and fatigue resistant properties associated with exodermic decks.

It is an additional object of the invention to make an exodermic deck design with a steel grid component wherein automated fabrication of the steel grid component is economically and technically feasible.

It is a further object of the invention to provide a deck in which a portion of either the main bearing bars or the distribution bars is embedded in the top component to provide vertical, lateral and longitudinal mechanical locks between the top component and the grid component effecting longitudinal and lateral horizontal shear transfer and preventing vertical separation.

It is yet another object of the invention to provide a structural floor having an open-lattice grating base member, or grid component, formed by main bearing bars and distribution bars. The distribution bars are perpendicular to the main bearing bars defining interstices therebetween. Unlike prior known exodermic designs, such as disclosed in the patents cited above, the shear connecting structure of the present invention may be comprised only of upper portions of either the main bearing bars or the distribution bars. A separate transfer element, such as dowels or studs is not needed. Most importantly, the present invention eliminates the need for tertiary bars, thus providing significant cost savings. The bridge deck also includes a reinforced concrete top component fixed to the grating base member which has a planar top surface and a planar bottom surface which is coplanar with top surfaces of the other of the main bearing bars or the distribution bars so that the top component does not fill the interstices of the grating base member. The shear connecting structure is embedded within the top component to (i) provide a mechanical lock and effect shear transfer in the longitudinal direction, i.e., parallel to the bar having the shear connecting structure, (ii) provide a mechanical lock and effect shear transfer in the lateral direction, i.e., perpendicular to the bar having the shear connecting structure, and (iii) prevent vertical separation between the top component and the grating base member.

These and other objects and features of the invention will be apparent upon consideration of the following detailed description of preferred embodiments thereof, presented in connection with the following drawings in which like reference numerals identify like elements throughout.

DETAILED DESCRIPTION OF THE PREFERRED EMBODIMENT

The invention disclosed and claimed herein comprises an exodermic deck, generally indicated at 10. Exodermic deck 10 is intended to contact, be supported on, and transmit forces to main structural framing members, not shown, either directly or through a concrete haunch, to form a structural floor which can be a bridge floor, a road bed, a pedestrian walkway, a support floor for a building, or the like. Exodermic deck 10 can be formed in-place or formed off-site in modular units and transported to the field and installed.

Exodermic deck 10 is a composite structure mainly comprised of an open-lattice grating base member or grid component 12, preferably made of steel, and a top component 14, preferably made of reinforced concrete. As described in more detail below, a portion of grid component 12 is embedded in top component 14 to advantageously transfer horizontal shear forces between concrete component 14 and grid component 12 and to maximize the benefits of the excellent compressive strength of concrete and the excellent tensile strength of steel.

Figure 1:
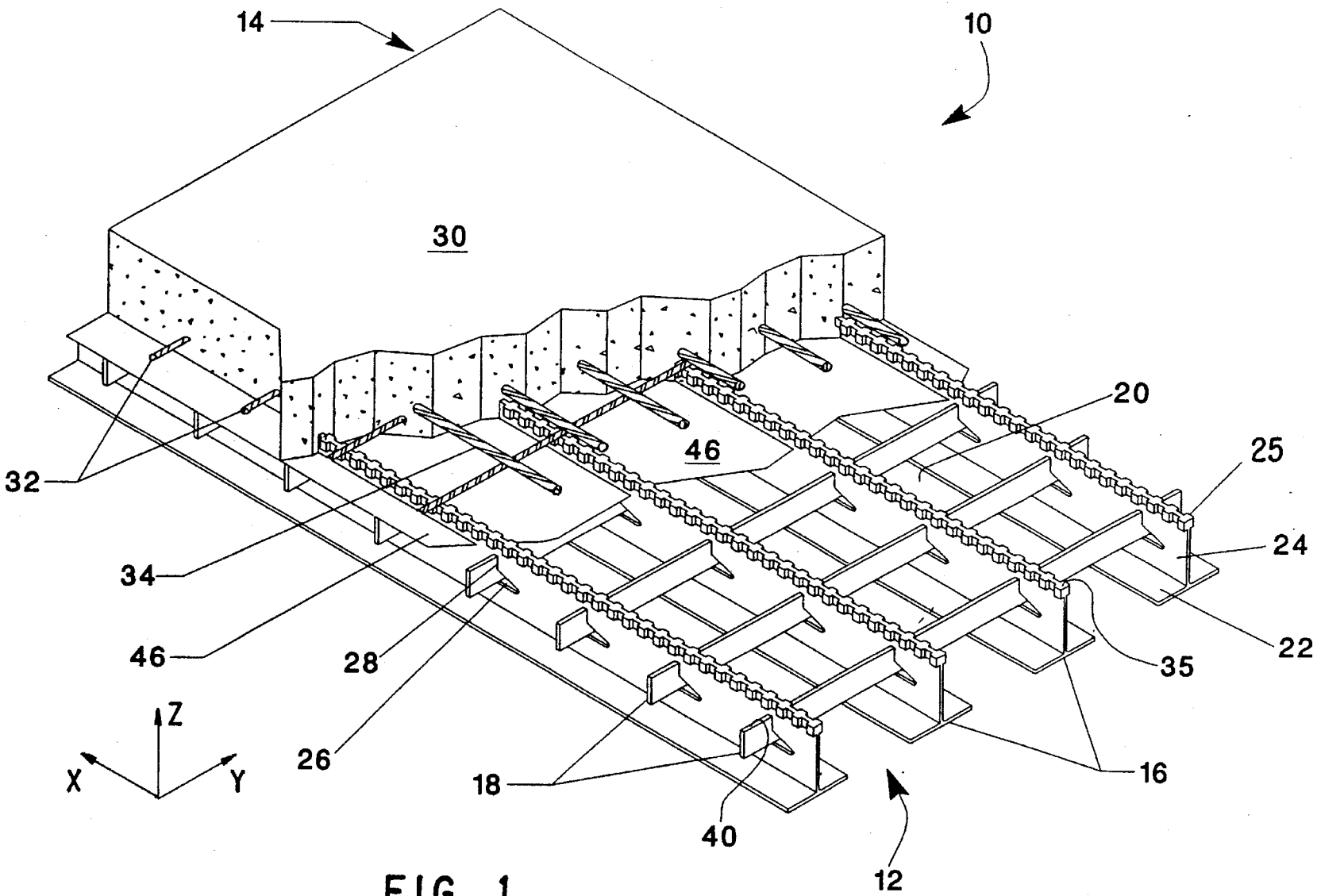
FIG. 1 is an isometric cutaway view of a structural floor in accordance with the present invention.

As shown in FIG. 1, grid component 12 includes a plurality of substantially parallel main bearing bars 16 (shown as extending in the X-direction) and a plurality of substantially parallel distribution bars 18 (shown as extending in the Y-direction) oriented perpendicular to main bearing bars 16. Main bearing bars 16 and distribution bars 18 intersect to define interstices 20 of grid component 12 therebetween. An aperture and slot assembly system, described hereinafter, permits distribution bars 18 to intersect and interlock with main bearing bars 16 and to distribute load transverse thereto.

Figure 2:
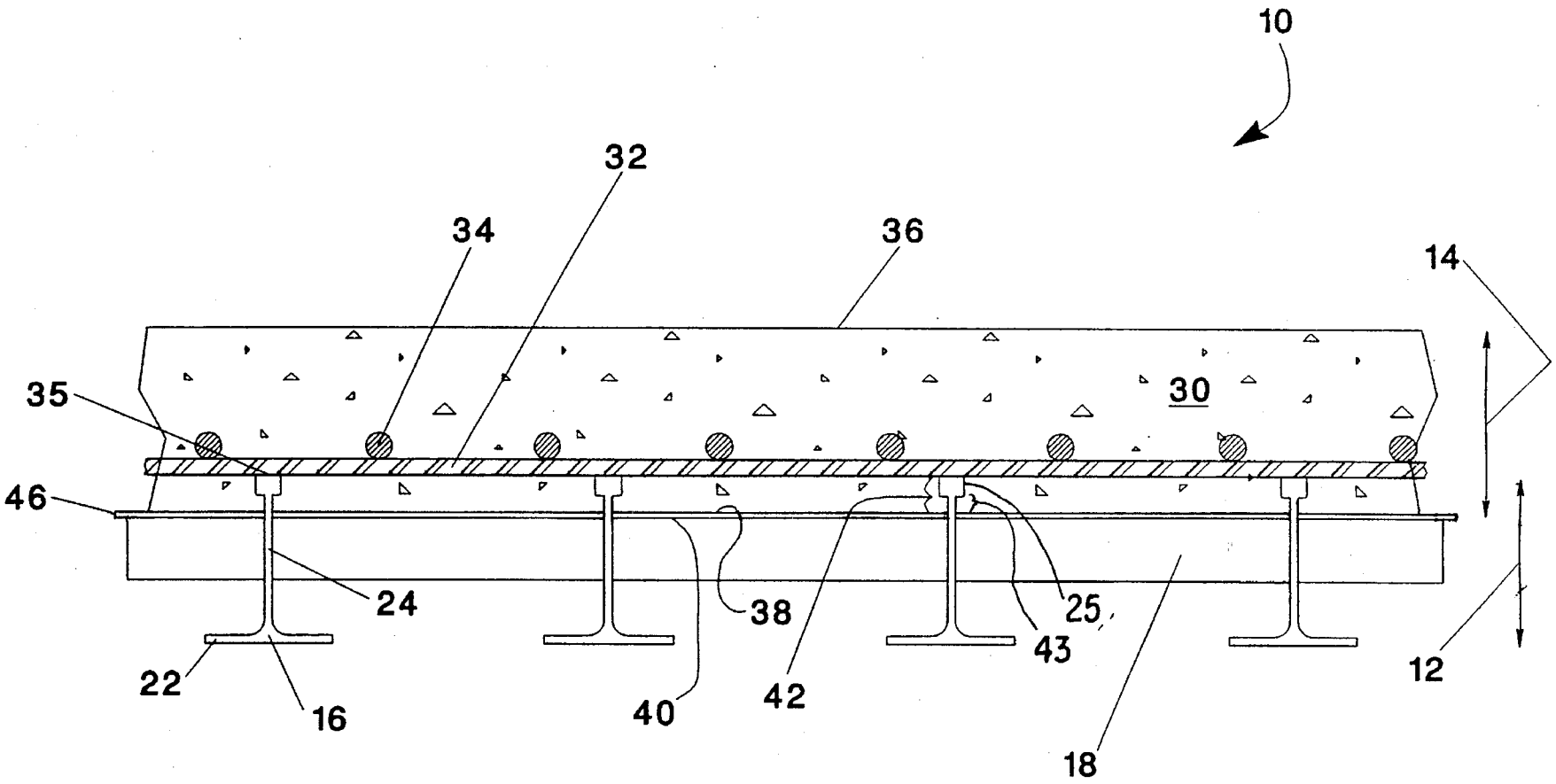
FIG. 2 is a vertical cross section of the structural floor of FIG. 1.

As best shown in FIG. 2, main bearing bars 16 are generally and most efficiently T-shaped and include a lower horizontal section 22, a substantially planar intermediate vertical section 24, and a top section 25. Assembly apertures 26 are provided in intermediate vertical sections 24 of main bearing bars 16 and the number of assembly apertures 26 in each main bearing bar 16 corresponds to the number of distribution bars 18 utilized in grid component 12. Each distribution bar 18 is a flat bar including a number of spaced assembly slots 28 for interaction with assembly apertures 26 in main bearing bars 16 to permit the distribution bars 18 to be inserted horizontally through assembly apertures 26 and rotated to lie in a vertical plane. Assembly apertures 26 may also include grooves, not pictured, for retaining distribution bars 18 in the vertical position. Distribution bars 18 are welded to main bearing bars 16 to maintain distribution bars 18 in the assembled position. A preferred aperture and slot assembly system is disclosed in U.S. Pat. No. 4,865,486, which is hereby incorporated by reference.

Top component 14 preferably consists of a material capable of being poured and setting, e.g., concrete 30. In the preferred design, concrete 30 is reinforced by a plurality of reinforcing bars, such as 32 oriented parallel to distribution bars 18 and a plurality of reinforcing bars, such as 34 oriented parallel to main bearing bars 16. Typically, the reinforcing bars 32, 34 are epoxy coated to inhibit corrosion. However, in lieu of reinforcing bars 32, 34, a reinforcing mesh may be used to reinforce concrete 30.

Concrete component 14 includes a planar top surface 36 providing a road surface, either directly or with a separate wear surface, and a planar bottom surface 38 located proximate the top surfaces 40 of distribution bars 18, and encompasses embedded upper portions 42 of main bearing bars 16. As best shown in FIG. 2, embedded upper portion 42 of each main bearing bar 16 includes top section 25 and the upper part 43 of intermediate vertical section 24. Upper part 43 of intermediate vertical section 24 of main bearing bars 16 being the portion of intermediate vertical section 24 which is located vertically above a horizontal plane defined by the top surfaces 40 of distribution bars 18.

Embedded upper portions 42 permit mechanical locks to be formed between concrete component 14 and grid component 12 in the vertical direction (Z-axis), and in a horizontal plane in the longitudinal (X-axis) and lateral (Y-axis) directions. The mechanical locks: (i) assure longitudinal and lateral horizontal shear transfer from concrete component 14 to grid component 12, (ii) prevent separation between concrete component 14 and grid component 12 in the vertical direction, and (iii) provide structural continuity with concrete component 14, permitting concrete component 14 and grid component 12 to function in a composite fashion. While a small chemical bond may be formed due to the existence of adhesives in the concrete, without a mechanical lock in the longitudinal direction (X-axis), the longitudinal shear transfer is insufficient to permit concrete component 14 and grid component 12 to function in a totally composite fashion.

Figures 3, 4, 5:
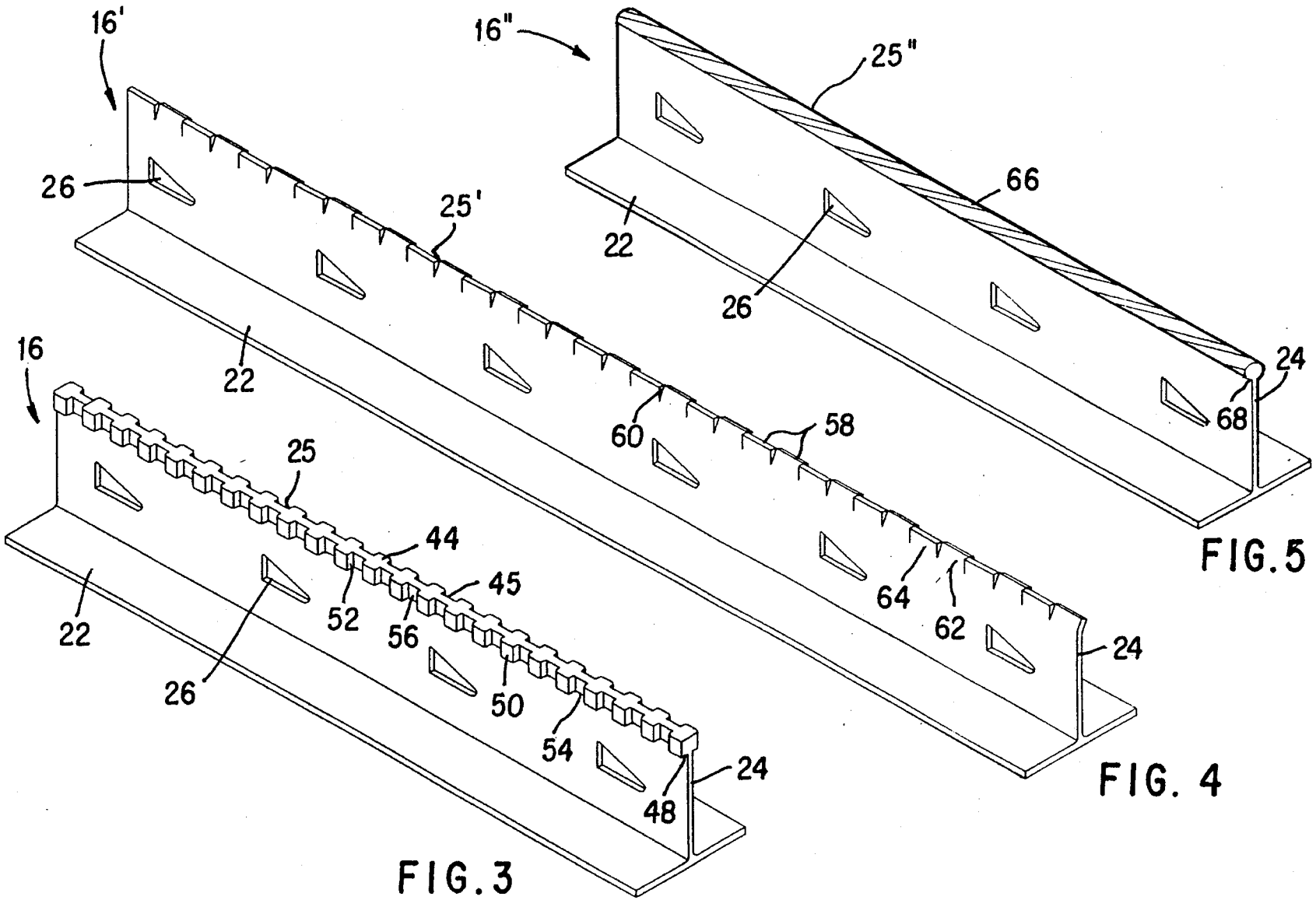
FIG. 3 is an isometric view of a main bearing bar of the structural floor of FIG. 1.
FIG. 4 is an isometric view of an alternate embodiment of a main bearing bar.
FIG. 5 is an isometric view of another alternate embodiment of a main bearing bar.

Top section 25, 25', or 25" of main bearing bar is deformed or otherwise shaped in the longitudinal direction (X-axis) to provide gripping surfaces. While the top section configurations of FIGS. 3–5 depict the gripping surfaces as being well defined planar surfaces, the gripping surfaces would most likely be more irregularly shaped due to material processing constraints. In addition, while FIGS. 3–5 disclose various top section configurations for providing gripping surfaces, any configuration providing sufficient gripping surfaces may be used.

A main bearing bar 16 having a top section 25 of a "bulge and recess configuration" is best shown in FIG. 3. Top section 25 includes a series of longitudinally spaced bulges or projections 44 with recesses 45 located therebetween.

Projections 44 and recesses 45 are preferably formed by rollers during the manufacturing process. Therefore, while projections 44 and recesses 45 are shown as being rectangular in nature, they are in actuality more rounded in shape. Projections 44 and recesses 45 provide surfaces 50 having a generally laterally facing component, and surfaces 52 having a generally longitudinal facing component.

Possible vertical (Z-axis) separation of concrete component 14 and grid component 12 is prevented by concrete engaging under top section 25. Enhanced horizontal shear transfer and mechanical locks in the longitudinal direction (X-axis) are achieved by the arrangement of gripping surfaces provided by adjacent sets of surfaces 52 and the existence of concrete therebetween. Horizontal shear transfer and mechanical locks in the lateral direction (Y-axis) are achieved by the concrete being on both lateral sides of upper portion 42.

FIG. 4 depicts an alternate embodiment of a main bearing bar 16' having a top section 25' of an "alternating angled tab configuration". Top section 25' includes a series of segregated, longitudinally spaced angled tabs 58. With respect to intermediate vertical section 24, adjacent tabs 58 are angled in opposite directions to provide longitudinally facing vertical surfaces 60, inner facing angled surfaces 64 generally facing a vertical plane defined by intermediate section 24, and angled facing outer surfaces 62 generally facing away from the vertical plane defined by intermediate section 24. The alternating tab configuration utilizes outer facing angled surfaces 62 to provide gripping surfaces resisting relative movement in the vertical direction (Z-axis) and longitudinally facing vertical surfaces 60 to provide gripping surfaces resisting relative movement in the longitudinal direction (X-axis), and therefore, permitting mechanical locks to be formed in their respective gripping directions.

Another alternate embodiment of a main bearing bar 16" having a top section 25" of a "rebar configuration" is shown in FIG. 5. Top section 25" is generally bar shaped having a diameter greater than the width of vertical section 24. Top section 25" further includes raised ridges 66 spirally located along its length to resemble what is commonly known as rebar or concrete reinforcing bar. The rebar configuration utilizes its downward facing circumferential area 68 to provide gripping surfaces resisting relative movement in the vertical direction and raised ridges 66 to provide gripping surfaces resisting relative movement in the longitudinal direction (X-axis), and therefore, permitting mechanical locks to be formed in their respective gripping directions. In lieu of or in addition to raised ridges 66, bar shaped top section 25" may include indentations therein having gripping surfaces to resist relative movement and to effect a mechanical lock in the longitudinal direction.

To maximize deck strength and minimize deck weight, it is desirable that planar bottom surface 38 of concrete component 14 is generally coplanar with top surface 40 of distribution bars 18 and that concrete 30 does not fill the interstices 20 of grid component 12. This feature can be achieved by a number of different methods.

In a preferred arrangement, intermediate barriers 46, e.g., strips of sheet metal, can be placed onto top surfaces 40 of distribution bars 18 between adjacent main bearing bars 16, as shown in FIG. 1. When concrete 30 or another material is subsequently poured onto grid component 12, intermediate barriers 46 create a barrier, preventing concrete 30 from travelling therethrough and filling interstices 20. Concrete 30 remains on intermediate barriers 46 creating planar bottom surface 38 of concrete component 14 which is generally coplanar with top surfaces 40 of distribution bars 18. However, in lieu of sheet metal strips, expanded metal laths, plastic sheets, fiberglass sheets, or other material can be used to create planar bottom surface 38. Additionally, biodegradable sheets, e.g., paper sheets, could also be used, as the primary purpose of intermediate barriers 46 is preventing concrete 30 from filling the interstices 20 of grid component 12, and this purpose is fully achieved once concrete 30 is cured.

Alternatively, planar bottom surface 38 of concrete component 14 can be formed by placing a lower barrier, e.g., a form board, underneath main bearing bars 16 and filling interstices 20 to a level substantially coplanar with the top surface 40 of distribution bars 18 with a temporary filler material, e.g., sand, plastic foam or other similar material. Concrete 30 may then be poured onto the temporary filler material and the temporary filler material will prevent concrete 30 from filling the interstices so that the bottom surface 38 of concrete component 14 is substantially coplanar with the top surface 40 of distribution bars 18. Once the concrete 30 is cured, the lower barrier and temporary filler material can be removed and the deck may be transported to site for installation. This technique is explained in U.S. Pat. Nos. 4,780,021 and 4,865,486 which are hereby incorporated by reference herein.

In the alternative, deck 10 can be formed by placing grid component 12 upside-down on top of concrete component 14, which would be inside a forming fixture, and to gently vibrate both components so that concrete component 14 cures to grid component 12 but does penetrate and fill interstices 20 of grid component 12. One well-known method of vibrating the components is to use a shake table, but other vibrating devices and techniques may also be used.

Exodermic deck 10 is particularly advantageous because it is believed to possess the same or similar strength and fatigue life characteristics as existing exodermic decks having the same section modulus per unit of width, but deck 10 can be produced at a substantially lower cost. In an exodermic deck 10 designed to have the same section modulus per unit of width as an existing exodermic deck with tertiary bars and separate shear connectors, upper portion 42 of main bearing bars 16 would be increased in height to provide the desired shear connecting structure and section modulus lost by the elimination of the tertiary bars. Most importantly, as exodermic deck 10 does not include tertiary bars or require separate vertical studs, the product cost of the tertiary bars and studs and the assembly costs of welding the studs to the tertiary bars and welding the tertiary bars to the distribution bars at each intersection is eliminated.

By the elimination of the necessity for tertiary bars and studs, the additional objective of permitting automatic fabrication of the grid component is achieved. Automatic fabrication of grid components having main bearing bars, distribution bars, and tertiary bars, with or without studs, is not feasible due to technical and economic restraints created by the extra step or steps which are involved in attaching the tertiary bars to the distribution bars and the studs, if used, to the tertiary bars. By utilizing a grid component 12 having only main bearing bars 16 and distribution bars 18, automated assembly of grid component 12 is economically and technically feasible.

In a preferred embodiment, concrete component 14 is 4.5-inches thick concrete. Main bearing bars 16 are 4-inch structural Ts or beams of similar rolled shape, with the top portions thereof being shaped to provide gripping surfaces. Bearing bars 16 weigh approximately 6.5-lbs/linear foot and are spaced apart on 10-inch centers. Distribution bars 18 are 1.5-inch by ¼-inch bars and are spaced apart on 6-inch centers. In addition, the intermediate barriers 46 are 20-gauge galvanized sheet metal strips. However, it is recognized that one skilled in the art could vary these parameters to meet the design requirements associated with specific sites.

The concrete 30 used is preferably high density, low slump concrete because it serves as an additional barrier to prevent moisture from reaching steel grid component 12 and causing premature deterioration. A preferred coarse aggregate is ⅜-inch crushed stone. A typical low slump is approximately 1 inch. A latex modified concrete, as is well known in the art, could also be used as the top layer. Concrete component 14 may further include a macadam or similar material wear surface (not shown) applied on top of component 14. Other concrete formulations providing adequate compressive strength may also be used.

Main bearing bars 16, and distribution bars 18 are preferably hot rolled steel and may be either galvanized, coated with an epoxy, or otherwise protected from future deterioration. Such protective coatings are well known in the art and take the form of an organic, powdered epoxy resin applied to the grid by an electrostatic process. Galvanized, aluminum anodic and aluminum hot dip coatings are also well known and effective. In addition, or as an alternative, weathering steel, such as A588, may be used.

Specific characteristics of exodermic decks and details for manufacturing exodermic decks are disclosed in the Applicant's prior U.S. Pat. Nos. 4,531,857, 4,531,859, 4,780,021, and 4,865,486, which are hereby incorporated by reference.

If desired, shear members, such as vertically oriented studs or dowels, not shown, may be vertically attached to upper portions 42 of main bearing bars 16 to provide additional structure to be embedded into concrete component 14. Preferably, the studs would be welded to main bearing bars 16 before the insertion of distribution bars 18. Alternatively, the studs may be otherwise fixed to, or integrally formed with, main bearing bars 16. For increased effectiveness, the studs would extend upwardly above top surface 35 of main bearing bars 16. The studs enhance the horizontal shear transfer from concrete component 14 to grid component 12.

An alternate arrangement could be used in which the upper portions of distribution bars 18, with or without shear members attached thereto, extend above the top surfaces of main bearing bars 16 and are embedded in concrete component 14 instead of upper portions 42 of main bearing bars 16. In such an arrangement, top surfaces of main bearing bars 16 would provide the necessary supporting structure for intermediate barriers 46. Further, distribution bars 18 would preferably have an upper portion designed to include gripping surfaces for creating mechanical bonds and increasing the shear transfer between grid component 12 and concrete component 14.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention. For example, while the preferred materials used for grid component 12 and top component 14 are steel and concrete, respectively, fiber-reinforced plastic and an epoxy-aggregate, e.g., epoxy-concrete, could also respectively be used. In addition, grid component 12 and top component 14 could be made from other materials recognized to one of ordinary skill.

We claim:

1. A structural floor comprising:

an open-lattice grating base member formed solely by a plurality of main bearing bars and a plurality of distribution bars and without any tertiary bars, said distribution bars being substantially perpendicular to said main bearing bars defining interstices therebetween, said distribution bars intersecting and interlocked with said main bearing bars to distribute load transverse to said main bearing bars, said distribution bars having a top surface and a bottom surface, said main bearing bars having a top surface and a bottom surface, said top surface of said main bearing bars being above said top surface of said distribution bars, and said bottom surface of said main bearing bars being below said bottom surface of said distribution bars, said main bearing and distribution bars forming an integral unit without any tertiary bars adapted to be supported on and transmit forces to main structural framing members;

said structural floor further having a top component fixed to said grating base member, said top component having a planar top surface and a planar bottom surface, said planar bottom surface being parallel and proximate to the top surfaces of said plurality of distribution bars so that said top component does not fill the interstices of said grating base member;

said main bearing bars having an upper shear transfer portion, said upper shear transfer portions of said plurality of main bearing bars being increased in height above the top surfaces of said plurality of distribution bars to thereby increase the section modulus per unit of width of the structural floor, said upper shear transfer portions of said plurality of main bearing bars embedded within said top component;

said upper shear transfer portion of said plurality of main bearing bars further including means for forming a mechanical lock between said integral grid and said top component when said upper shear transfer portions are embedded in said top component; said upper shear transfer portions of said main bearing bars effecting shear transfer between said top component and said grating base member in a horizontal direction parallel to said embedded main bearing bars and in a horizontal direction perpendicular to said embedded main bearing bars.

2. The structural floor of claim 1, wherein said top sections of said plurality of main bearing bars further include longitudinally spaced projections having said means for forming said mechanical locks.

3. The structural floor of claim 1, wherein said top sections of said plurality of main bearing bars include longitudinally spaced angled tabs including generally vertical surfaces, said tabs being angled in a direction opposite of adjacent tabs with respect to a vertical axis defined by said intermediate vertical sections.

4. The structural floor of claim 1, wherein said top sections of said plurality of main bearing bars include a generally bar shaped member with protrusions thereon for forming said mechanical lock in a horizontal direction parallel to said embedded main bearing bars.

5. The structural floor of claim 1, wherein said top sections of said plurality of main bearing bars include a generally bar shaped member with indentations therein for forming said mechanical lock in a horizontal direction parallel to said embedded main bearing bars.

6. The structural floor of claim 1 wherein said main bearing bars include apertures therein and said distribution bars include slots for interacting with said apertures of said main bearing bars, and wherein said distribution bars are extended through and rotated in said apertures permitting said distribution bars to lie in a vertical plane such that said top surfaces of said distribution bars are located below the upper portions of the main bearing bars and above said apertures of the main bearing bars.

7. The structural floor of claim 1, wherein said top component is reinforced concrete and said plurality of main bearing bars and distribution bars are steel.

8. The structural floor of claim 1, wherein said top component is an epoxy-aggregate and said plurality of main bearing bars and distribution bars are fiber-reinforced plastic.

9. The structural floor of claim 1, wherein said structural floor is a bridge deck.

10. The structural floor of claim 1, wherein said structural floor is a walkway.

11. A module for a structural floor having an open-lattice grating base member comprising:

an open-lattice base member, said grating base member having a plurality of main bearing bars and a plurality of distribution bars and without any tertiary bars, said distribution bars being substantially perpendicular to said main bearing bars defining interstices therebetween, said distribution bars intersecting and interlocked with said main bearing bars to distribute load transverse to said main bearing bars, said distribution bars having a top surface and a bottom surface, said main bearing bars having a top surface and a bottom surface, said top surface of said main bearing bars being above said top surface of said distribution bars, and said bottom surface of said main bearing bars being below said bottom surface of said distribution bars, said main bearing and distribution bars forming an integral modular unit without any tertiary bars adapted to be supported on and transmit forces to main structural framing members, said top surfaces of said plurality of distribution bars defining a horizontal axis;

a top component fixed to said grating base member above said horizontal axis, said top component having a planar top surface and a planar bottom surface, said planar bottom surface being parallel and proximate to said horizontal axis so that said top component does not fill the interstices of said grating base member;

said main bearing bars having an upper shear transfer portion, said upper shear transfer portions of said plurality of main bearing bars including lock means for providing mechanical locks between said top component and said grating base member, said lock means being embedded within said top component; said upper shear transfer portion of said plurality of main bearing bars effecting shear transfer between said top component and said grating base member in a horizontal direction parallel to said embedded main bearing bars and in a horizontal direction perpendicular to said embedded main bearing bars.

12. The module of claim 11, wherein said main bearing bars include apertures therein and said distribution bars include slots for interacting with said apertures of said main bearing bars, and wherein said distribution bars are extended through and rotated in said apertures permitting said distribution bars to lie in a vertical plane such that said top surfaces of said distribution bars are located below the upper portions of the main bearing bars and above said apertures of the main bearing bars.

* * * * *